United States Patent [19]

Blenman

[11] 4,054,423

[45] Oct. 18, 1977

[54] VARIABLE PRESSURE FUEL GENERATOR AND METHOD

[76] Inventor: Orman L. Blenman, 69 Drexel Road, Buffalo, N.Y. 14214

[21] Appl. No.: 597,342

[22] Filed: July 21, 1975

[51] Int. Cl.[2] ..... C10H 5/00

[52] U.S. Cl. ..... 48/2; 48/3 R; 48/4; 48/23; 48/191; 48/216; 123/3

[58] Field of Search ..... 23/282; 123/3; 48/2, 48/4, 23, 24, 9, 31, 37, 58, 61, 27, 28, 216, 3 R, 12, 56, 191

[56] References Cited

U.S. PATENT DOCUMENTS

| | | | |
|---|---|---|---|
| 595,668 | 12/1897 | Bryant | 48/9 |
| 599,394 | 2/1898 | Lawn | 48/4 |
| 604,879 | 5/1898 | Goodwin | 48/37 |
| 615,997 | 12/1898 | Lewes | 48/216 |
| 890,439 | 6/1908 | McIntire | 48/4 |
| 1,095,217 | 5/1914 | Krauss | 48/37 |
| 1,272,727 | 7/1918 | Thompson | 48/191 |
| 1,312,731 | 8/1919 | Horsley | 48/4 |
| 2,472,084 | 6/1949 | Beller et al. | 48/3 R |
| 2,676,876 | 4/1954 | Mosely | 48/191 |
| 3,787,186 | 1/1974 | Geres | 48/37 |

*Primary Examiner*—S. Leon Bashore
*Assistant Examiner*—Peter F. Kratz
*Attorney, Agent, or Firm*—Christel & Bean

[57] ABSTRACT

A method and apparatus for generating acetylene gas by reacting water and calcium carbide wherein a tank containing water is pressurized by a pump in a manner feeding the water to another vessel wherein it reacts with particulate calcium carbide to generate acetylene gas. A portion of the acetylene gas is returned through a pressure regulator to the water tank in a manner maintaining regulated system operating pressure on the water to sustain the reaction without overproduction of the gas. The apparatus can be located in a vehicle for on board generation of acetylene gas as fuel for the internal combustion engine thereof.

8 Claims, 4 Drawing Figures

VARIABLE PRESSURE FUEL GENERATOR AND METHOD

BACKGROUND OF THE INVENTION

This invention relates to the art of chemical gas generation, and more particularly to a new and improved method and apparatus for generating acetylene gas.

One area of use of the present invention is in generating acetylene gas as a fuel for internal combustion engines, although the principles of the present invention can be variously applied. For vehicle engines it would be highly desirable to provide on board generation of aceylene gas to avoid the need to store the gas in the vehicle which storage can give rise to problems of safety and of vehicle design to accommodate the storage tank. In generating acetylene on board a vehicle, it is important that such generation meet the demand or fuel requirement of the engine in a manner which does not result in overproduction of the acetylene gas. Furthermore, the acetylene gas should be supplied to the engine in a manner providing efficient engine operation.

SUMMARY OF THE INVENTION

It is, therefore, an object of this invention to provide a new and improved method and apparatus for generating acetylene gas from the chemical reaction between calcium carbide and water.

It is a further object of this invention to provide such a method and apparatus wherein the rate of gas generation is efficiently and effectively controlled.

It is a further object of this invention to provide such a method and apparatus for use on a vehicle to supply fuel to the vehicle internal combustion engine in an efficient manner and not resulting in overproduction of acetylene gas.

The present invention provides a method and apparatus for generating acetylene gas by the reaction between water and calcium carbide wherein an enclosed quantity of water is pressurized by means such as a pump to force feed the water to a reaction zone containing particulate calcium carbide. A portion of the acetylene gas product is pressure regulated and returned to the enclosed quantity of water to maintain a regulated system operating pressure on the water. The water fed to the reaction can be used to absorb heat released by the reaction, and the output acetylene gas product can be passed through another quantity of particulate calcium carbide whereby any water vapor in the gas reacts with the calcium carbide to generate additional acetylene. The generation of acetylene gas can be done on board a vehicle to supply fuel to the internal combustion engine thereof in which case the acetylene gas is pre-mixed with air prior to additional mixing with air in the engine carburetor.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
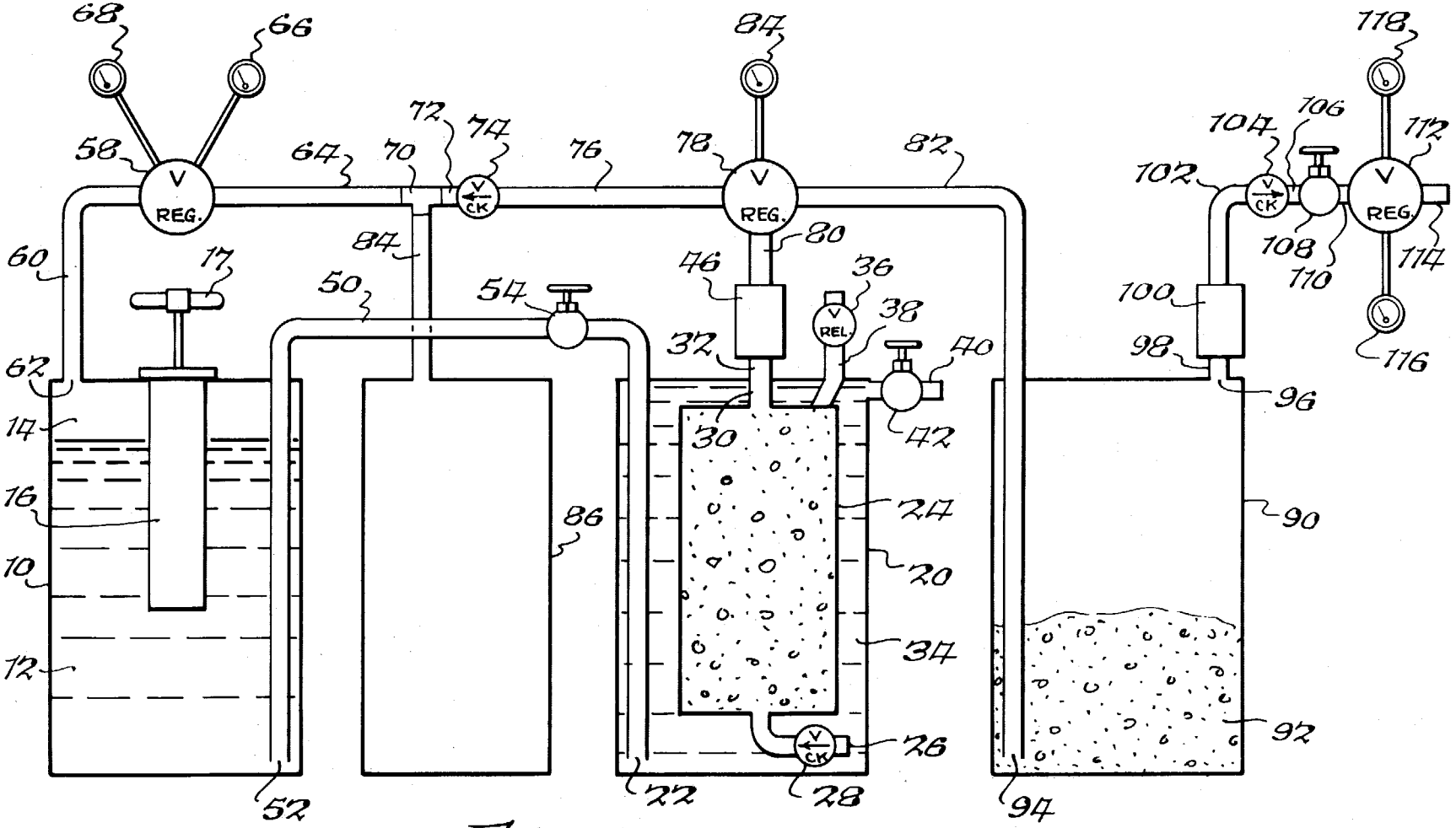
FIG. 1 is a diagrammatic view of apparatus for generating acetylene gas according to the present invention.

Referring now to FIG. 1, there is shown apparatus according to the present invention for generating gas from the reaction between a first reactant in liquid form, in the present illustration water, and a second reactant, in the present illustration calcium carbide, the gas generated by the reaction being acetylene gas. The apparatus comprises means in the form of a gas-tight vessel or tank 10 defining a gas-tight region in the interior thereof which contains the liquid reactant, in the present instance a quantity of water designated 12. As shown in FIG. 1, water 12 occupies a major portion of the volume of the interior region of vessel 10, but does not completely fill the same so as to leave an empty space or region 14 of the sealed interior above the water 12. The apparatus further comprises means for pressurizing the space 14 over the water 12 in vessel 10, the pressurizing means comprising a pump 16 operatively associated with vessel 10 and operating by a mechanical input applied exteriorly of vessel 10 and having a pressure output within vessel 10 in communication with the upper portion of the interior region of the vessel. Pump 16 can be of the manually-operating type having a handle 17 extending out from the vessel or tank 10 which when reciprocated pumps or pressurizes the interior of vessel 10 in a known manner similar to hand pumps provided on spray guns or similar devices. Alternatively, pump 16 could comprise a compressor separate from vessel 10 wherein the pressure output is connected by suitable conduit means to the interior of vessel 10.

The apparatus of the present invention further comprises means defining a gas-tight reaction zone containing the second reactant, in the present illustration solid calcium carbide in particulate form, and having a gas product outlet for removing generated gas. In particular, there is provided a gas-tight vessel or tank 20 having an inlet 22 for admitting liquid reactant supplied thereto from tank 10. A gas-tight housing or container 24 is positioned in the interior of vessel 20 and contains the second reactant, in the present illustration solid calcium carbide in particulate form. Housing 24 has an inlet at one end in the form of a relatively short conduit 26 in communication with the interior of vessel 20 to admit the liquid reactant contained therein. A check valve 28 in conduit 26 allows the liquid, i.e. water, to flow from the interior of vessel 20 into container 24 but prevents flow from the interior of container 24 to the interior of vessel 20. The interior of container 24 at the other end is connected by a conduit 30 to a gas product outlet 32 of vessel 20. Thus, gas product, i.e. acetylene, generated by the reaction which occurs in container 24 leaves the portion of the apparatus including vessel 20 and container 24 through outlet 32. Container 24 is suitably fixed in position within the interior of vessel 20 and generally centrally thereof, and in the present illustration container 24 is held at the upper end thereof by the connection of conduit 30 to outlet 32 and is supported adjacent the lower end thereof by conduit 26 resting adjacent the bottom surface of vessel 20. Other supporting arrangements can of course be employed. The positioning of container 24 spaced within and from a substantial portion of the inner surface of vessel 20 allows liquid reactant 34 in the interior of vessel 20 to contact a substantial portion of the exterior surface of container 24 to absorb heat released from the reaction occurring therein in a manner which will be described in detail presently. A pressure relief valve 36 connected to the interior of vessel 24 by a conduit 38 functions as a safety relief valve to release gas pressure from the interior of vessel 24 if it should reach a predetermined level considered to be unsafe. Another conduit 40 adjacent the upper end of vessel 20 and containing a valve 42 serves as a bleeder to allow liquid at the level of conduit 40 to flow out from the interior of vessel 20 under control of valve 42 when necessary. A filter 46 can be connected to gas product outlet 32 for removing any particulate contaminant material from the gas product flowing therethrough, for example calcium oxide dust product of the reaction.

The apparatus of the present invention further comprises means in the form of conduit 50 for placing the interior of the vessel or tank 10 in communication with the reaction zone within container 24 positioned in vessel 20 whereby the liquid reactant, i.e. water, is supplied under pressure to the reaction zone. In particular, one end 52 of conduit 50 is located in tank 10 adjacent the lower end thereof and defines an outlet for removing liquid reactant therefrom. The other end of conduit 50 is located adjacent the lower end of vessel 20 and comprises previously-mentioned inlet 22 of vessel 20. Conduit 50 is provided with a valve 54 therein for controlling the flow of liquid reactant from tank 10 to the reaction zone.

The apparatus of the present invention further comprises means connecting the outlet of the reaction zone to the gas-tight region containing the liquid reactant for supplying a portion of the gas product to that region to maintain pressure over the liquid reactant. In particular, the arrangement shown in the drawing includes a series of conduits connecting gas product outlet 32 to the space 14 in vessel 10 over the liquid reactant 12, and a pressure regulator 58 is provided in the flow path to limit the magnitude of pressure applied to the liquid reactant 12 in vessel 10 to a selected system operating pressure. Regulator 58 is preset to a selected system operating pressure, and the outlet port of regulator 58 is connected by a conduit section 60 the the region or space 14. The end 62 of conduit 60 thus defines an inlet for supplying a portion of the gas product to the space over the liquid reactant. The inlet port of regulator 58 is connected by a conduit 64 to an arrangement defining a flow path from gas product outlet 32 in a manner which will be described in detail presently. Regulator 58 can be of various commercially available types which are well known to those skilled in the art. For example, regulator 58 can be of type including a spring-biased flow control element therein whereby pressure regulation is accomplished due to the force constant of the spring acting against the forces of the fluid pressure and wherein an externally available adjustment acts on the spring so that a maximum pressure amplitude can be preselected. One form of regulator found to perform satisfactorily in the apparatus of the present invention is commercially available under the designation Sears pressure regulator and gauge Model No. 106.160351. Pressure regulator 58 can be provided with a gauge 66 for indicating the pressure magnitude at the outlet portion connected to conduit 60 and with another pressure gauge 68 for indicating the pressure magnitude at the regulator inlet port connected to conduit 64.

Conduit 64 is connected at the other end thereof to one port of a fitting or connector 70 and another port of connector 70 is connected by a conduit 72 to one port of a check valve 74, the other port of which is connected by a conduit 76 to the outlet port of a pressure regulator 78. Check valve 74 is connected so as to allow fluid flow in a direction from regulator 78 toward regulator 58 and to prevent fluid flow in the opposite direction. The inlet port of pressure regulator 78 is connected by a conduit 80 section to the output of filter 46, and the other outlet port of regulator 78 is connected by a conduit 82 for withdrawing generated gas product for further processing by the apparatus and for use. Regulator 78 can be identical to regulator 58 and in the present illustration is equipped with a gauge 84 in a manner indicating the magnitude of pressure in the one outlet port connected to the conduit 76. A third port in the fitting or coupling 70 is connected by a branch conduit 84 to the interior of a tank or gas-tight vessel 86 which functions as a reservoir or surge tank in a manner which will be described in detail presently.

The apparatus of the present invention further comprises means in the form of a gas-tight vessel or tank 90 containing a quantity 92 of the second reactant, i.e. calcium carbide material in particulate form. Conduit 82 leads into tank 90 with the end 94 thereof within the quantity of reactant 92. As a result, gas product traveling through conduit 82 flows through the reactant material 92 whereupon it leaves the vessel 90 through an outlet 96 comprising the end of a conduit section 98. Any liquid reactant vapor contained in the generated gas flowing along conduit 82 will react further with the quantity of reactant 92 within vessel 90 thereby generating additional gas product which along with the initial gas product leaves vessel 90 through outlet 96. A filter 100, identical to filter 46, serves to remove particulate contaminants from the gas stream, for example calcium oxide dust. A conduit 102 connects filter 100 to one port of a check valve 104, the other port of which is connected by a conduit 106 to one port of a control valve 108, the other port of which is connected by a conduit 110 to the inlet port of a pressure regulator 112. Check valve 104 is connected to allow flow in a direction from tank 90 to regulator 112 and to prevent flow in the opposite direction. The outlet port of regulator 112 is connected by a conduit 114 which serves to supply the generated gas to a point or location of use. Regulator 112 is identical to regulators 78 and 58, and regulator 112 is set to a selected system operating pressure in a manner identical to that for pressure regulator 58. A pressure gauge 116 connected to regulator 112 indicates the pressure magnitude in the inlet port connected to conduit 110, and another pressure gauge 118 connected to regulator 112 indicates pressure magnitude in the regulator outlet port connected to conduit 114.

The apparatus of FIG. 1 operates in the following manner. In generating acetylene gas according to the method of the present invention, a quantity of calcium carbide in particulate form is placed in container 24. Using generally elongated particles, i.e. rice shaped particles, of calcium carbide and filling the entire interior volume of container 24 with the particles has been found to provide satisfactory results. Container 24 would have a suitable opening with movable closure element (not shown) to receive the particulate material, the mounting arrangement for container 24 in vessel 20 would be releasable, and vessel 20 would have a suitable opening with movable closure element (not shown) to receive the filled container 24 whereby the supply of calcium carbide can be periodically replenished as it is consumed by operation of the apparatus.

With the filled container 24 in place within vessel 20 and with vessel 20 sealed closed, a quantity of liquid reactant in the form of water is introduced to the apparatus in the following manner. The vessel or tank 10 would have a suitable liquid inlet provided with a gas-tight closure element (not shown) adjacent the upper portion of tank 10 as viewed in FIG. 1. With valve 54 closed, water is introduced to tank 10 up to a level below the top of the tank sufficient to leave the empty region or space 14.

The next phase of the start-up procedure is pressurizing the interior space 14 in tank 10 above the liquid 12. This is done by manually operating pump 16, i.e. by reciprocating handle 17, to increase the pressure in region 14 and acting on the quantity of water 12. As the pressure is increased, water forced along conduit 50 cannot flow past the closed valve 54, but the pressure is sensed by meter 66 of regulator 58 which is connected to region 14 by conduit 60. The pump 16 is operated until the desired system operating pressure is reached as indicated by gauge 66, and, for example, in a small scale gas generator a system operating pressure of about 15 p.s.i. was found to provide satisfactory results.

The apparatus now is in condition to begin generating acetylene gas, and when valve 54 is opened, the pressure in region 14 forces water along conduit 50 to feed it into vessel 20 and then through conduit 26 and valve 28 into container 24. The water reacts with calcium carbide in container 24 to produce acetylene gas according to the well known chemical reaction. The water accumulating in tank 20 surrounds container 24, contacting a major portion of the outer surface thereof, and serves to absorb heat from container 24 released by the chemical reaction therein and thus functions as a coolant. The acetylene gas product leaves container 24 through conduit 30 and outlet 32, flows through filter 46 which removes particulate contaminants such as calcium oxide dust, and then flows into regulator 78 from which a portion leaves through conduit 82 for further processing and use and from which the remainder leaves through conduit 76 for maintaining the system operating pressure in a manner which now will be described.

As the generated gas pressure in the system increases, water will continue to flow until the generated gas pressure equals the pressure acting on the water. In particular, the gas pressure at outlet 32 tends to reach a level higher than the predetermined system operating pressure in the region 14 acting on the water. This generating gas pressure can tend to reach a level 5–5 p.s.i. higher than the system operating pressure. Check valve 28 connected to the inlet of container 24 prevents reverse flow of generated gas. Pressure regulator 78 therefore is set at a level about 5 to 10 p.s.i. greater than the desired system operating pressure and regulator 78 thus providing protection against excessive build-up of generated gas pressure. The output pressure at regulator 78 is indicated by gauge 84. Generated gas flows along conduit 78 through check valve 74 and along conduit 84 into vessel 86 which serves as a surge tank. The generated gas pressure in surge tank 86 increases to a magnitude equal to the generated gas pressure at the output of regulator 78. Due to the fact that reverse gas flow is prevented by check valve 74, if the pressure at regulator 78 drops, the gas in surge tank 86 will not return to regulator 78. If the pressure at the output of regulator 58 decreases, however, gas will flow from surge tank 86 into regulator 58 and then into region 14 to compensate for the decrease in system operating pressure. Thus regulator 58 and the portion of the apparatus operatively connecting it to the gas product outlet 32 maintains the desired system operating pressure on the water supply in tank 10 to sustain the feeding of water to the reaction zone to sustain the chemical reaction producing acetylene gas. In addition, this is done in a manner which avoids overproduction of the gas.

The useable gas pressure is the gas pressure which is available in conduit 114 at the output of regulator 112. This pressure, which is indicated by gauge 118, should be kept at least 5 p.s.i. below the system operating pressure and, for example, should be no more than 10 p.s.i. with a system operating pressure of 15 p.s.i. As useable gas output in conduit 114 is consumed, the gas pressure in tanks 20 and 90 decreases, and when this pressure falls below the system operating pressure, the pressure acting on water 12 in tank 10 forces more water into container 24 to generate additional gas which results in a build-up of gas pressure again in tank 20 and 90. Thus, with regulator 58 set at the desired system operating pressure, for example 15 p.s.i., when the generated gas pressure is greater than 15 p.s.i. there is no further gas generation and when the generated gas pressure is less than 15 p.s.i. additional gas is generated. This cyclic manner of operation continues until all of the water or calcium carbide is consumed. Valve 108 serves as a shut-off valve when it is desired to stop the output flow of gas product, and valve 54 can be closed when the apparatus is to be inoperative for a significant amount of time. Thus the apparatus of the present invention provides for efficient and effective control of the rate of gas generation and avoids overproduction of gas.

Heat is released during the chemical reaction between the water and calcium carbide in container 24. The water in vessel 20 serves as a coolant and this same water enters container 24 to react with the calcium carbide. If sufficient heat remains in container 24 to vaporize some of the incoming water, the acetylene gas leaving through outlet 32 will contain some water vapor. This gas and water flows along conduit 82 and then rises upwardly through the quantity 92 of calcuim carbide in tank 90 wherein the water vapor reacts with the calcium carbide thereby generating additional acetylene gas and removing the water vapor. Thus, additional gas is produced and the output gas is dry.

Pressure relief valve 36 on tank 20 is a safety measure to release any pressure which may become dangerously high. Check valve 104 prevents the output acetylene gas from flashing back into tank 90. Filters 46 and 100 serve to prevent calcium oxide dust and other particulate impurities from entering the lines, regulators and valves. In the foregoing example utilizing a system operating pressure of 15 psi, tanks 10, 20 and 90 all were of 1–2 gallon liquid capacity. The apparatus can be of small size so as to be portable or it can be considerably larger, depending upon the amount of gas product required.

Figure 2:
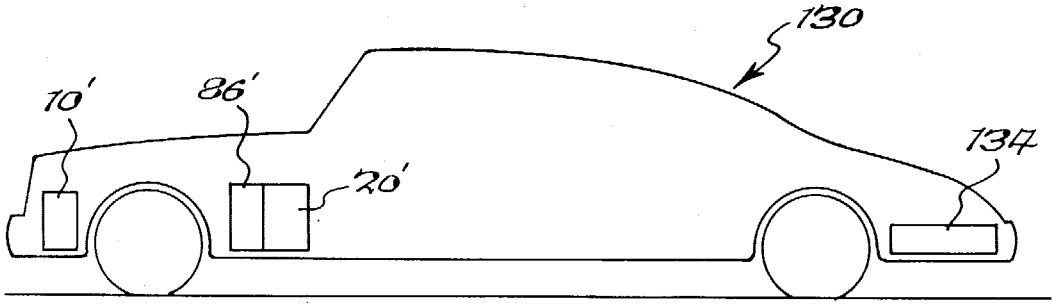
FIG. 2 is a diagrammatic view showing a vehicle equipped with the apparatus of the present invention to supply acetylene gas fuel to the internal combustion engine thereof.
Figure 3:
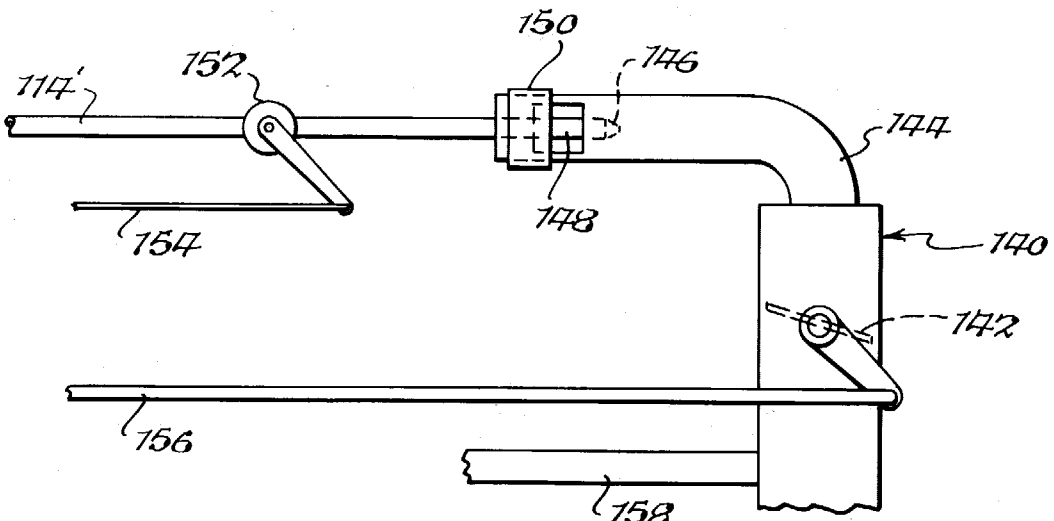
FIG. 3 is a diagrammatic view of an arrangment according to the present invention for supplying acetylene gas to the carburetor of an internal combustion engine.

FIGS. 2 and 3 illustrate the apparatus of the present invention used for on-board generation of acetylene gas as fuel for the internal combustion engine of a vehicle. A conventional automobile 130 is powered by a standard internal combustion engine which can use as fuel acetylene gas generated by the apparatus of the present invention. The automobile can use either acetylene or conventional gasoline as fuel but not both simultaneously. FIG. 2 illustrates a typical installation of the apparatus of the present invention wherein the water tank 10' can be placed under the hood of vehicle 130 at the front end thereof and the reaction vessel 20' and surge tank 86' also can be located under the hood rearwardly of tank 10'. Tank 90' can be located adjacent tank 20' laterally thereof. A conventional gasoline storage tank is designated 134, and if vehicle 130 is to operate only on acetylene gas, then tank 10' can be placed in the location of gasoline tank 134. Appropriate controls and gauges would be provided in the vehicle dashboard, and controls for the acetylene generating apparatus would be operatively connected to the vehicle ignition system so that acetylene gas flow is stopped when the ignition key is turned off. If the vehicle is to be capable of using both acetylene and gasoline at selected times there will be a selector control for activating either the acetylene system or the gasoline system. For example, when the control is operated to select the acetylene mode, the gasoline fuel pump will be shut off, and when the control is operated to select the gasoline mode, valve 108 would be closed.

FIG. 3 illustrates a preferred manner of connecting the output of the acetylene generator of the present invention to a standard carbureator of an internal combusion engine. A portion of a conventional carburetor is shown diagrammatically at 140 and includes a throttle valve element 142. A conduit 144 connected at one end to carburetor 140 adjacent the upper end thereof services to mix acetylene gas and air in the following manner. Conduit 114' from the output of an acetylene gas generator of the present invention extends into the open end of conduit 144 terminating in an end defining an orifice 146 spaced slightly downstream from an air inlet opening 148 in the wall of conduit 144. An adjustable slidable control element 150 on conduit provides adjustment of the size of air inlet opening 148. A valve 152 in conduit 114' controls the flow of acetylene gas, and the vehicle accelerator pedal is operatively connected to valve 152 and throttle element 142 as indicated by lever lines 154 and 156, respectively. A conduit 158 connected at one end to carburetor 140 downstream from throttle element 142 is connected at the other end to the engine exhaust for a purpose to be described.

Carburetor 140 also has a standard air inlet in addition to the arrangement of conduits 144 and 114' for mixing air and acetylene. It is important that the fuel and air mixture not be too rich to avoid fouling of the engine spark plugs. The arrangement illustrated in FIG. 3 provides pre-mixing of the acetylene and air before the air-fuel mixture enters the carburetor to mix with the main source. The throttle element 142 is ganged with the fuel valve 152 to insure a constant proper fuel and air mixture. In a conventional carburetor, the liquid gasoline must be vaporized and mixed with air before being injected into the cylinder, whereas in the arrangement of the present invention the fuel, i.e. acetylene, advantageously already is in gaseous form. The ability to pre-mix the gaseous fuel with air can also reduce the possibility of engine knocking. In addition, knocking and rate of fuel burning can be controlled by returning the hot exhaust gases, containing carbon dioxide and inactive gases, to the carbureator by means of conduit 158.

The advantages of the apparatus of the present invention for on-board generation of acetylene gas as fuel for internal combustion engines are illustrated further by the following calculations. The heating value of one gallon of gasoline is equal to 115,000 BTU per gallon, and since gasoline weighs 7 pounds per gallon, in each pound of gasoline the heating value is 16,428.571 BTU. The heating value of one gram of acetylene is 47.6110 BTU, and since there are about 453.6 grams in one pound, one pound of acetylene by weight has a heating capacity of 21,596.311 BTU.

When acetylene is compared to one gallon of gasoline of gasoline by weight, i.e. 7 pounds of gasoline and 7 pounds of acetylene, the heating value of acetylene is then 151,174.17 BTU compared to the one gallon of gasoline that has a heating value 115,000 BTU. Thus acetylene has a heating value factor of 1.3145 greater than that of gasoline by unit weight.

The molar weight of calcium carbide is 3.56 times greater than the molar weight of water. If one pound of water is used then 3.56 pounds of calcium carbide must be used to balance the chemical reaction. The end result of the reaction is 3.1 pounds of calcium oxide and 1.46 pounds of acetylene, according to the relationship.

$$CaC_2 + H_2O \rightarrow CaO + C_2H_2$$

The formula for determining the weight of acetylene derived from a certain weight of calcium carbide mixed with the proper amount of water is $W_{acetylene} = W_{calcium\ carbide}$ (0.410) where W is the weight in pounds. For example, if one hundred pounds of calcium carbide is used in the car, then twenty eight pounds of water would be required. Actually, a slight excess of water should be used to allow for water loss through vaporization. One hundred pounds of calcium carbide occupies space that is equal to ten gallons, and twenty eight pounds of water is equal to 3.1 gallons since water weighs 9 pounds per gallon. Thus, the total space occupied by the two reactants is 13.1 gallons, and forty one pounds of acetylene will be generated.

Assuming that a given vehicle operates at 20 miles per gallon of gasoline, when the two fuels are compared in terms of BTU, the vehicle can travel 153.98 miles on the 41 pounds of acetylene generated while the same vehicle can travel only 117.14 miles on forty one pounds of gasoline. The foregoing calculations were based only on BTU of the two fuels. Actually, it is expected that the vehicle can travel more than 153.98 miles on 41 pounds of acetylene due to the fact that acetylene is already in gasoline form so there is no need to vaporize it, and being in gaseous form it mixes better with air than a liquid fuel.

Figure 4:
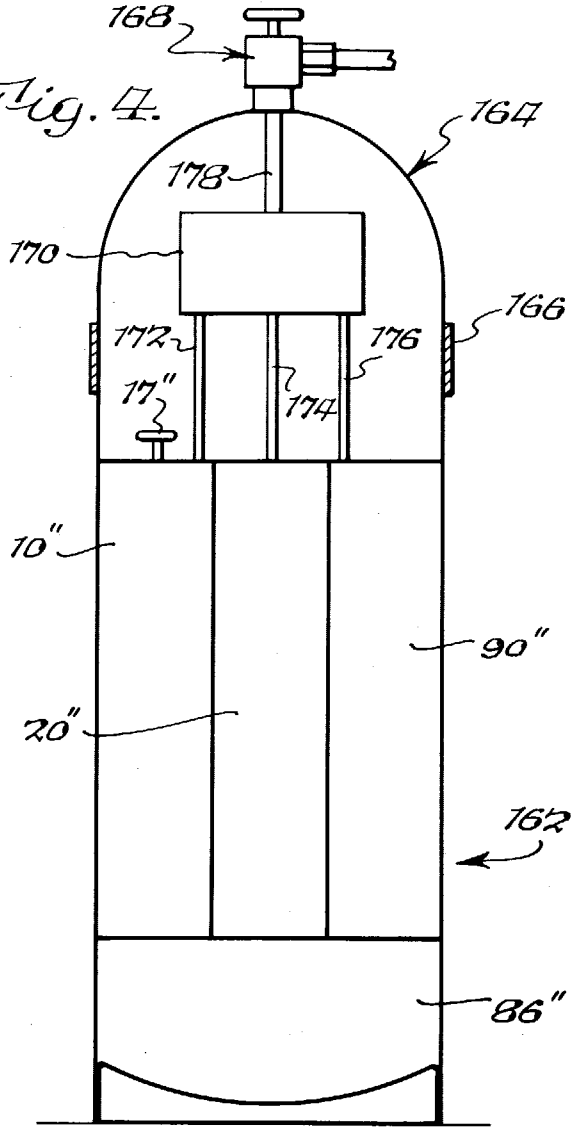
FIG. 4 is a diagrammatic view showing the apparatus of the present invention housed in a cylinder to supply acetylene gas for welding.

FIG. 4 illustrates the manner in which the apparatus of the present invention can be employed in a cylinder for in situ generation of acetylene gas for use in oxyacetylene welding. A conventional cylinder 162 is provided with a cap or top 164 releasably secured thereto by clamps 166, and the unit typically is about 4 feet long and 1½ to 2 feet in diameter. Acetylene generating apparatus similar to that of FIG. 1 is included in cylinder 162 with tank 86" adjacent the closed or bottom end as viewed in FIG. 4 and tank 10", 20" and 90" located adjacent tank 86". The valves and regulators of the apparatus are collectively designated 170 and are connected by the conduits 172, 174 and 176 to the tanks 10", 20" and 90", respectively. Tank 10" is initially pressurized by a manually operated pump, the handle of which is designated 17". The apparatus contained within the cylinder operates in a manner similar to the apparatus of FIG. 1 to generate output acetylene gas available in conduit 178 and which is withdrawn from the cylinder under control of valve 168. By virtue of the foregoing arrangement, acetylene gas does not have to be compressed in a cylinder but can be generated in the cylinder by the apparatus of the present invention. There are of course other uses, in addition to welding, such as propelling aircraft and ships, chemical manufacturing and as a heating fuel.

It is therefore apparent that the present invention accomplishes its intended objects. While several embodiments of the present invention have been described in detail, this is for the purpose of illustration, not limitation.

I claim:

1. Apparatus for generating gas from the reaction between a first reactant in liquid form and a second reactant, said apparatus comprising:

a. means defining a gas-tight region containing the liquid reactant;
b. means for pressurizing the space over the liquid reactant in the gas-tight region;
c. means defining a gas-tight reaction zone containing the second reactant and having a gas product outlet for removing generated gas;
d. means for placing said gas-tight region in communication with said reaction zone in a manner whereby the liquid reactant is supplied under pressure to said reaction zone;
e. conduit means connected at one end to said gas product outlet of said reaction zone and at the other end to said gas-tight region for supplying a portion of the gas product to said region to maintain pressure over the liquid reactant;
f. pressure regulator means operatively connected to said conduit means for limiting the magnitude of pressure applied to said liquid reactant to a selected system operating pressure;
g. check valve means in said conduit means between said pressure regulator means and said gas product outlet allowing flow only in a direction from said outlet toward said regulator;
h. second pressure regulator means operatively connected to said conduit means between said check valve means and said gas product outlet, said second pressure regulator means limiting the pressure magnitude of generated gas product at a level above the selected system operating pressure as limited by said first-named pressure regulator means; and
i. resevoir means operatively connected to said conduit means between said first named regulator and said check valve means for storing a constant volume of gas product.

2. Apparatus according to claim 1 wherein said means defining a gas-tight region containing the liquid reactant comprises a gas-tight vessel having outlet means in communication with the lower portion of the interior region of said vessel for removing liquid reactant and having inlet means in communication with the upper portion of the interior region of said vessel for supplying said portion of said gas product to the space over the liquid reactant and wherein said pressurizing means comprises pump means operatively associated with said vessel, said pump means being operated by a mechanical input applied exteriorly of said vessel and having an output within said vessel in communication with the upper portion of the interior region of said vessel.

3. Apparatus according to claim 1, wherein said means defining a reaction zone containing the second reactant comprises:

a. a vessel having an interior region and inlet means for admitting the liquid reactant to said interior region; and
b. a gas-tight housing positioned in the interior of said vessel and containing the second reactant, said housing having an inlet in communication with the interior of said vessel to admit liquid reactant and an outlet operatively connected to said gas product outlet for releasing gas product generated in said container;
c. the liquid reactant in the interior of said vessel contacting a substantial portion of the exterior surface of said container to absorb heat released from the reaction in said container.

4. Apparatus according to claim 1, wherein said means placing said gas-tight region in communication with said reaction zone includes valve means for controlling the flow of liquid reactant to said reaction zone.

5. Apparatus according to claim 1, further including:

a. second conduit means connected in fluid communication with said gas product outlet for supplying generated gas for use; and
b. pressure regulator means operatively connected to said conduit means for limiting the magnitude of generated gas pressure to a selected system operating pressure.

6. Apparatus according to claim 1, further including:

a. means defining a second gas-tight region containing a quantity of said second reactant therein;
b. means placing said gas product outlet in communication with said second reactant in said gas-tight region in a manner such that liquid reactant vapor contained in generated gas leaving said gas product outlet reacts further with said quantity of second reactant to generate additional gas product; and
c. means connected to said said second gas-tight region for withdrawing gas product therefrom.

7. Apparatus according to claim 6, wherein said means for withdrawing gas product from said second gas-tight region comprises conduit means and pressure regulator means operatively connected to said latter conduit means for limiting the magnitude of output gas pressure to a selected system operating pressure.

8. A method of generating acetylene gas by the reaction between water and calcium carbide comprising the steps of:

a. providing a quantity of water in a gas-tight enclosure in a manner providing an empty region over said water;
b. pressurizing said region over said water;
c. transmitting said water by the force of the pressure acting thereon into a gas-tight enclosure containing calcium carbide and reacting said water and calcium carbide to produce acetylene gas product;
d. withdrawing acetylene gas product of the reaction;
e. returning a portion of the acetylene gas product to said region to maintain pressure acting on said water said step of returning including limiting the magnitude of said pressure applied to said water to a selected system operating pressure with a first pressure regulator, limiting the pressure magnitude of generated acetylene gas product at a level above said selected system operating pressure with a second pressure regulator, and storing a constant volume of acetylene gas product obtained from the product returned to said region for use in compensating for any decrease in the system operating pressure, said stored gas product being at said pressure level above said system operating pressure, and the flow of said returned acetylene gas product being limited to a single direction toward said first regulator; and f. using the water transmitted to said enclosure to absorb heat released by the reaction; and g. passing the acetylene gas product through a quantity of particulate calcium carbide whereby any water vapor in the acetylene gas product reacts with the calcium carbide to produce additional acetylene gas.

* * * * *